United States Patent [19]

Johnson et al.

[11] 3,957,201

[45] May 18, 1976

[54] CONCRETE RAILROAD TIE ANCHOR STRUCTURE

[75] Inventors: Edwin O. Johnson, Kansas City, Mo.; Thomas S. Carter, Overland Park, Kans.

[73] Assignee: The Kansas City Southern Railway Company, Kansas City, Mo.

[22] Filed: Oct. 11, 1974

[21] Appl. No.: 514,089

[52] U.S. Cl. ..... 238/298; 238/85; 238/265; 238/283; 238/315; 238/349

[51] Int. Cl.[2] ..... E01B 9/02

[58] Field of Search ..... 238/83, 84, 85, 91, 238/106, 264, 265, 272, 273, 274, 283, 310, 315, 318, 319, 321, 323, 349, 297, 298

[56] References Cited

UNITED STATES PATENTS

| | | | |
|---|---|---|---|
| 723,280 | 3/1903 | Jaques | 238/265 X |
| 864,311 | 8/1907 | Lancaster | 238/265 X |
| 1,028,878 | 6/1912 | Hill | 238/91 |
| 2,196,534 | 4/1940 | Neal | 238/349 X |
| 3,544,006 | 12/1970 | Pennino | 238/283 |
| 3,717,302 | 2/1973 | Neumann | 238/349 X |
| 3,826,424 | 7/1974 | McClung et al. | 238/283 X |

FOREIGN PATENTS OR APPLICATIONS

| | | | |
|---|---|---|---|
| 215,453 | 1/1957 | Australia | 238/283 |
| 1,938,281 | 7/1970 | Germany | 238/349 |
| 660,185 | 4/1938 | Germany | 238/298 |

*Primary Examiner*—Robert J. Spar
*Assistant Examiner*—Randolph A. Reese
*Attorney, Agent, or Firm*—Lowe, Kokjer, Kircher, Wharton & Bowman

[57] ABSTRACT

An improved anchor structure for use with concrete railroad ties. A modular base plate is cast into the concrete tie with integral upwardly projecting shoulders extending from the base plate which complement it to present a seat to support a steel railroad rail. An anchoring portion is also integral with each shoulder and extends downwardly to anchor the device in the tie. The shoulder also presents an opening for receiving a retaining spring clip. A resilient rubber or fiber pad is disposed on the seat between the rail and the base plate. The pad is characterized by laterally projecting tabs which abut the bridging portion on either side to preclude lateral movement of the pad. The retaining spring clip engages the rail base and also has a leg projecting through the opening. A curvilinear portion of the clip complementally engages an arcuate segment of the briding portion while a second leg is disposed in a groove presented by the bridging portion.

7 Claims, 5 Drawing Figures

CONCRETE RAILROAD TIE ANCHOR STRUCTURE

This invention relates generally to railroad construction and maintenance and, more particularly, to an improved concrete railroad tie and anchor structure for use therewith.

There have been many attempts over the years to introduce concrete railroad ties to the railway industry. While concrete ties have gained considerable acceptance in Europe and Japan, they have not been widely used in the United States. The major reason for the lack of acceptance is, of course, the abundance of timber in this country from which timber ties may be cut.

With increasing lumber shortages, however, the economics of concrete ties have become more and more feasible. One reason why concrete ties have not been economically feasible heretofore is a certain degree of unreliability which is a factor in maintenance costs. In most instances, the maintenance costs can be traced directly to the anchor which is utilized to fasten the rail to the concrete tie.

One form of prior art anchor which has been accepted to some degree outside of this country is a relatively thick tapered member having an opening at the end exposed above the concrete tie for inserting a spring clip or retaining pin. Some of the disadvantages of this form of anchor, however, are its high cost, a relatively thick epoxy coating which must be placed on it to electrically insulate it, and some failures when the anchor pulls out of the concrete. Another disadvantage of the particular prior art anchor discussed above is the fact that the rail is seated directly on the concrete tie thus causing wear of the concrete. Other prior art anchors have provided a plate on which the rail may rest but have not incorporated satisfactory means to anchor the plate into the concrete.

It is a primary object of the present invention to provide an anchor for use with concrete railroad ties which includes a plate that forms a seat for the rails so as to preclude direct contact between the rail and the concrete tie while also incorporating a method to retain exact gauge of the rails (the distance between rails) which is an absolute necessity for safe railway operation.

It is also an object of the present invention to provide anchor structure for use with concrete railroad ties wherein only two anchor components are required for holding a pair of rails on a single tie thus minimizing the difficulties in the manipulating process of a concrete tie in a mold or form and simplifying alignment over what is required with four individual components.

One of the objectives of this invention is also to provide a more effective anchor for use with concrete ties than has heretofore been possible as a result of the novel anchoring means which is utilized.

As a corollary to the above object, it is one of the aims of this invention to construct the anchor means with less thickness than is possible with less effective anchors thereby increasing the distance between the metal anchor and reinforcing running through the concrete tie resulting in less insulative coating being required to prevent conduction from the anchor to the reinforcing rods.

It is also one of the objects of this invention to provide a unitary anchor for use in a concrete tie which can be shaped from flat metal stock as a result of the fact that there are no openings presented by the anchor itself.

Another important objective of this invention is to provide a novel rubber or fiber pad for use in conjunction with a concrete anchor which novel pad is designed to preclude movement relative to the rail and the anchor.

Other objects of the invention will be made clear or become apparent from the following description and claims when read in light of the accompanying drawing wherein:

Figure 2:
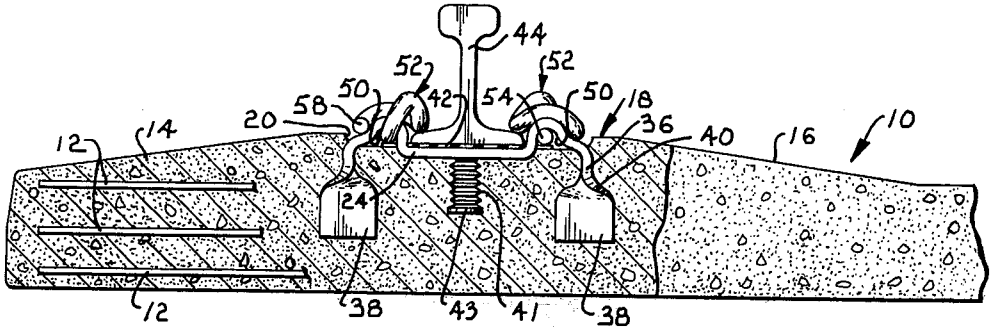
FIG. 2 is a side elevational view, partially in cross section, showing an anchor embedded in a concrete tie and holding a rail in place.

Referring initially to FIG. 2, a pre-formed concrete railroad tie is designated generally by the numeral 10 and preferably is provided with pretensioned strand reinforcing lengths 12 extending through it. It is to be understood that only approximately one-half of the total length of tie 10 is illustrated in FIG. 2, the other half being identical to the half shown and described herein. Upwardly inclined surfaces 14 and 16 of tie 10 merge into a generally horizontal planar area designated by the numeral 18. Area 18 is provided with a recess 20 and it is to be understood that the surface presented by the recess will normally be inclined at a slight angle although this detail has been omitted from the drawing for the sake of clarity.

Figure 1:
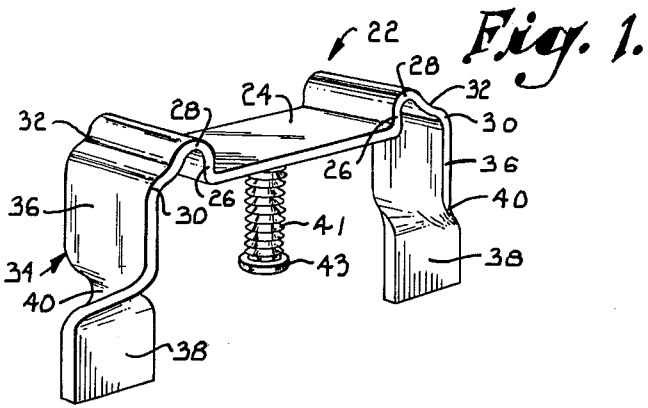
FIG. 1 is a perspective view of one form of anchor which is constructed according to the teachings of the present invention.

Embedded in concrete tie 10 at the area of recess 20 is an anchor structure designated generally by the numeral 22 and illustrated in FIG. 1. Anchor structure 22 comprises a base plate 24 which presents a generally planar surface with integral upwardly projecting shoulders 26 extending from either end of the plate. Shoulders 26 are integral with and merge into a bridging portion comprising a first generally arcuate segment 28 and a second generally arcuate segment 30 integral with the first segment. Each of segments 28 and 30 is formed by two intersecting arcs to provide a groove 32 along the line of juncture of the two arcuate segments.

Integral with and projecting downwardly from the second segment 30 is an anchor blade designated generally by the numeral 34. Anchor blade 34 comprises a first generally planar blade portion 36 and a second generally planar blade portion 38 disposed in a plane perpendicular to the plane of the first portion 36. An interconnecting portion 40 is integral with and merges into each of first and second portions 36 and 38 and has opposed sides which merge into the sides of portions 36 and 38. Secured to the bottom of plate 24 is a threaded stud 41 which terminates in an enlarged head 43. Stud 41 is preferably secured to plate 24 by spot welding although other techniques could be utilized.

Figure 3:
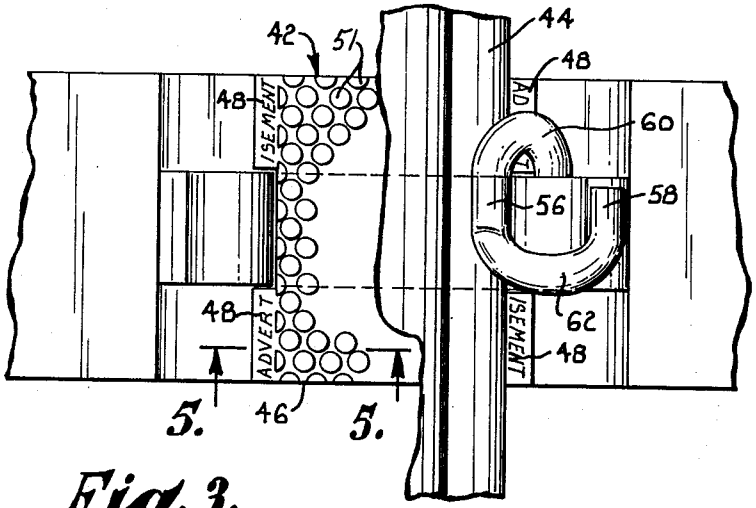
FIG. 3 is a fragmentary top plan view of the rail and anchor shown in FIG. 2.

It will be appreciated that in use of anchor 22 it is relatively easy to align two of the anchors in a mold for tie 10 as opposed to four anchor components required with some prior art devices. Anchor structure 22 is preferably placed so that plate 24 is partially embedded in the concrete with the planar surface of the plate being coplanar with the plane of the surface presented by indentation 20. A rubber or fiber pad designated generally by the numeral 42 and best illustrated in FIG. 3 is placed on plate 24 between the plate and a railroad rail 44. Pad 24 comprises a generally polygonal body 46 with laterally projecting tabs 48 extending on either side of shoulders 26 so as to preclude movement of the pad relative to the concrete tie. Opposed surfaces of pad 42 are provided with protuberances 51 which provide a non-slip surface as they firmly grip both the concrete tie and rail 44. It is preferable to omit the protuberances at tabs 48 so as to leave a smooth surface for printing of some form of advertisement by the manufacturer of the rubber pad.

Shoulders 26 cooperate with plate 24 to provide a seat for rail 44 in the manner illustrated in FIG. 2. With anchor 22 embedded in the concrete, arcuate segments 28 cooperate with the concrete tie to present openings 50 through which retaining clips designated generally by the numeral 52 are inserted. Each clip 52 comprises a first leg 54 extending through opening 50, a second leg 56 lying along the edge of rail 44 (FIG. 3) and a third leg 58 disposed in groove 32. Legs 54 and 56 are interconnected by an integral arcuate section 60 and legs 56 and 58 are joined by an integral curvilinear section 62. Section 62 is configured to complementally engage the outer surface of each of the arcuate segments 28 so as to facilitate retention of the clip. Clip 52 normally is constructed with a certain amount of spring tension so that as it is forced into its rail retaining position, the metal in the clip will be sprung, thus facilitating retention of the clip in the anchor as well as retention of the rail.

Figure 4:
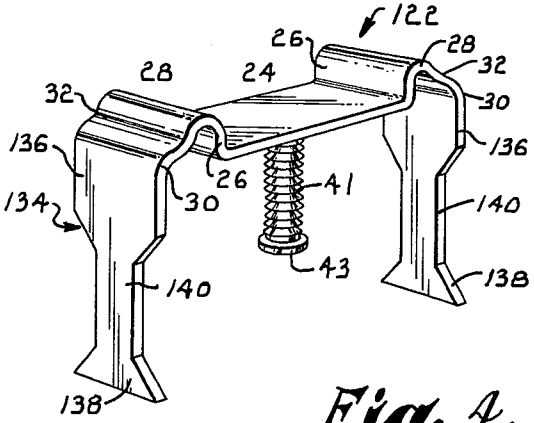
FIG. 4 is a perspective view of an alternative form of anchor construction.
Figure 5:
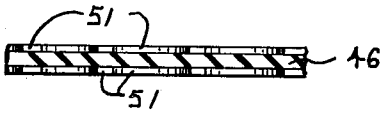
FIG. 5 is a cross sectional view taken along line 5—5 of FIG. 3 and showing details of construction of the rubber pad.

An alternative form of the invention is illustrated in FIG. 4 and is designated generally by the numeral 122. Anchor 122 is constructed identically to the anchor 22 described above except for the anchor blade which is integral with second arcuate segment 30. In the embodiment illustrated in FIG. 4 the anchor blade is designated generally by the numeral 134 with a generally planar first blade portion 136 which cooperates with a lower blade portion 138 and an interconnecting blade portion 140 to present a generally I-shaped anchor blade member. This form of construction is preferred when fabricating costs are considered over the form illustrated in FIGS. 1–3 although both forms of the invention are superior in their anchoring properties.

It has been found that an anchor constructed according to the present invention offers superior holding properties while also reducing wear of the concrete tie. The relatively thin construction of the anchor blade increases the distance between the blades and the reinforcing bars so as to reduce the requirement for an insulative coating.

Having thus described the invention, we claim:

1. Anchor structure for use in securing a railroad rail to a concrete tie, said structure comprising:

a base plate adapted to be disposed in a generally horizontal position on the tie;

upwardly projecting shoulders rigid with said base plate at opposite sides thereof and extending away from said plate to cooperate therewith in presenting a seat for said rail;

a bridging portion rigid with each of said shoulders and extending away from the adjacent end of the base plate in the general direction of said tie to cooperate with the latter in presenting an opening;

blade means integrally connected with said bridging portion and extending downwardly from the end of said bridging portion which is farthest removed from said base plate, in a continuous, uninterrupted manner;

said blade means including a planar vertically oriented upper blade portion integral with said bridging portion, a planar vertically oriented intermediate blade portion extending below said upper blade portion and having a lateral dimension less than that of said upper blade portion, and a planar lower blade portion having a greater lateral dimension than said intermediate blade portion, said lower blade portion presenting a pair of opposed anchoring edges facing generally upwardly and outwardly on opposite sides thereof.

2. Anchor structure as set forth in claim 1, wherein said base plate is of a width greater than the base of said rail.

3. Anchor structure as set forth in claim 1, wherein is included a downwardly extending protuberance rigid with said base plate and presenting an irregular surface area for engagement with the concrete tie.

4. Anchor structure as set forth in claim 1, wherein the rail is held in place on said seat by a retaining pin inserted through said opening, said retaining pin having a curvilinear portion, said bridging portion comprising a first generally arcuate segment complemental to the curvilinear portion of said retaining pin.

5. Anchor structure as set forth in claim 4, wherein said bridging portion comprises a second generally arcuate segment extending in an arc intersecting the arc of the first segment to present a groove along the line of juncture of the first and second segments, said groove receiving a section of said retaining pin.

6. Anchor structure as set forth in claim 4 wherein is included a resilient pad disposed on said seat intermediate the rail and the plate, said pad comprising a generally planar body having opposed sides presenting non-skid surfaces and taps projecting laterally along each side of each of said shoulders so as to preclude movement of the pad once the rail is seated.

7. A concrete railroad tie and anchor structure for holding rails on a road bed comprising:

an elongated block of reinforced concrete spanning the distance between two parallel rails;

a base plate adapted to be disposed in a generally horizontal position on the tie;

integral upwardly projecting shoulders rigid with said base plate at opposite sides thereof and extending away from said plate to cooperate therewith in presenting a seat for said rail;

a first generally arcuate segment integral with each of said shoulders and extending away from the adjacent end of the base plate in the general direction of said concrete block to cooperate with the latter in presenting an opening;

a second generally arcuate segment integral with each of said first segments and extending in an arc intersecting the arc of the first segment to present a groove along the line of juncture of the first and second segments;

blade means integrally connected with each of said second segments and extending downwardly from the end of said second segments which is farthest removed from said base plate in a continuous uninterrupted manner;

said blade means including a planar vertically oriented upper blade portion integral with said bridging portion, a planar vertically oriented intermediate blade portion extending below said upper blade portion and having a lateral dimension less than that of said upper blade portion, and a planar lower blade portion having a greater lateral dimension than said intermediate blade portion, said lower blade portion presenting a pair of opposed anchoring edges facing generally upwardly and outwardly on opposite sides thereof;

a resilient pad disposed on said seat intermediate the rail and the plate; and a retaining pin disposed in each of said openings and engaging said rail for holding the rail in place on said seat, said pin comprising a first leg extending through said opening, an integral curvilinear portion complementally engaging said first arcuate segment, and an integral second leg disposed in said groove.

* * * * *